United States Patent [19]

Gonzalez

[11] Patent Number: 4,785,834

[45] Date of Patent: Nov. 22, 1988

[54] HAIR GRIPPER DEVICE

[76] Inventor: Miriam E. Gonzalez, 605 NW. 72 Ave., Miami, Fla. 33126

[21] Appl. No.: 51,511

[22] Filed: May 19, 1987

[51] Int. Cl.[4] ..... A45D 8/00

[52] U.S. Cl. ..... 132/275

[58] Field of Search ..... 132/46 R, 44, 47; 24/17 R, 17 A, 17 AP; 2/338

[56] References Cited

U.S. PATENT DOCUMENTS

| | | | |
|---|---|---|---|
| 607,604 | 7/1898 | Mackay | 132/46 R |
| 2,401,132 | 5/1946 | Boecker | 2/338 |
| 2,795,232 | 6/1957 | Klein et al. | 132/47 |
| 2,796,069 | 6/1957 | Mooney, Jr. | 132/46 R |
| 2,805,673 | 9/1957 | Solomon | 132/47 |
| 2,945,500 | 7/1960 | Bolinger | 132/47 |
| 3,000,384 | 9/1961 | Piers, Jr. | 132/46 R |
| 3,081,781 | 3/1963 | Stermer | 24/17 AP |
| 3,542,041 | 11/1970 | Mercorella | 132/46 R |

FOREIGN PATENT DOCUMENTS

| | | | |
|---|---|---|---|
| 652323 | 10/1937 | Fed. Rep. of Germany | 132/46 R |
| 24385 | of 1896 | United Kingdom | 132/46 R |

*Primary Examiner*—Gene Mancene
*Assistant Examiner*—Cary E. Stone
*Attorney, Agent, or Firm*—J. Sanchelima

[57] ABSTRACT

A hair gripper device for keeping a user's hair in place and including an elongated flexible sheet with an elastic member that is affixed, in stretched out state, to the inner surface of the sheet. Snap buttons are mounted at the ends of the sheet to secure the ends against each other.

3 Claims, 2 Drawing Sheets

HAIR GRIPPER DEVICE

BACKGROUND OF THE INVENTION

1. Field of the Invention

The present invention relates to hair gripper devices, and more particularly, to such devices that can adjust to different thickness and quantity of hair.

2. Description of the Related Art

From time immemorial, women specially have used a variety of devices to hold their hair in place. One of these devices is disclosed in U.S. Pat. No. 2,796,069 issued to J. E. Mooney, Jr. in 1957. The pony tail holder uses snap fastener elements 18 to hold the hair of the user in place. The petal shape element 17, however, is relatively complicated and lacks the necessary flexibility for adjusting to different hair thicknesses and amounts of hair of the user.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hair gripper device that is capable of adjusting to different amounts of hair with fastening elements that are easily removable.

It is another object of this invention to provide such a device that is practical to carry inside a purse or pocket.

It is still another object of this invention to provide a device for holding the user's hair that can have a plurality of accessories removably attached thereto.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
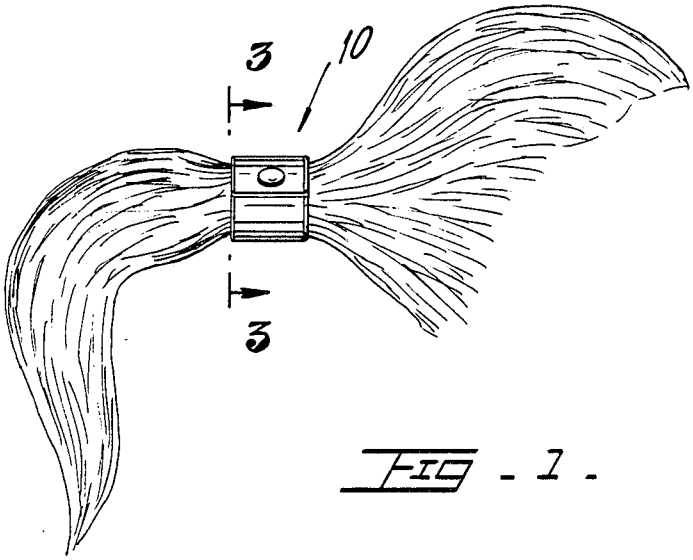
FIG. 1 represents the present invention in use.
Figure 2:
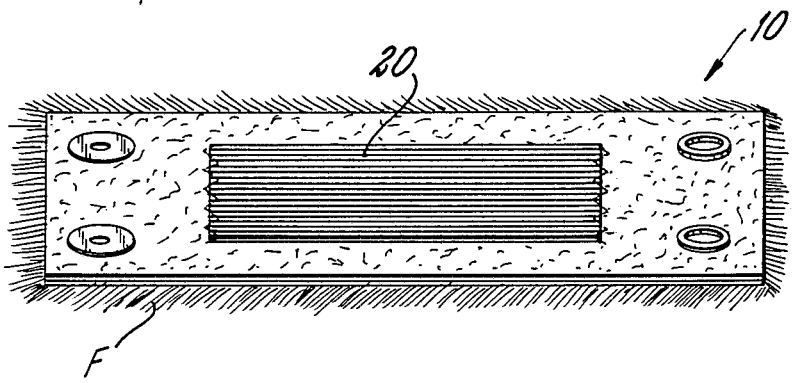
FIG. 2 shows a perspective view of the internal surface of a preferred embodiment for the present invention.

Referring now to FIG. 1, where the present invention is generally referred to with numeral 10, it can be observed that it provides a firm grip to the user's hair. Basically, this is accomplished by incorporating an elastic member 20, as shown in FIG. 2, that is mounted to the inner surface of device 10.

Figure 3:
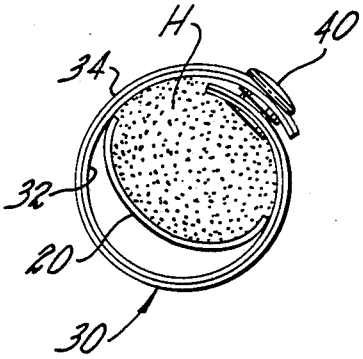
FIG. 3 illustrates an end view of the hair gripper device shown in FIG. 1 as it is seen from line 3—3.

As it can be seen in FIG. 3, elastic member 20 is affixed to the inner surface of elongated flexible sheet member 30 in stretched state so that it causes the latter to curve and help provide the necessary gripping pressure to hair H. Elastic member 20 is shorter than flexible sheet member 30 and it is centrally affixed to sheet 30 at its ends, as shown in FIGS. 2 and 3. Sheet member 30 is actually composed, in the embodiment depicted in FIGS. 1; 2 and 3, of two layers of flexible material affixed to each other. Inner layer 32 and outer layer 34. Inner and outer layers 32 and 34 are flexible and the former one does not have any finishing while the latter includes an aesthetically appealing finishing. In FIG. 2, outer layer 34 includes a fur finishing F.

Figure 4:
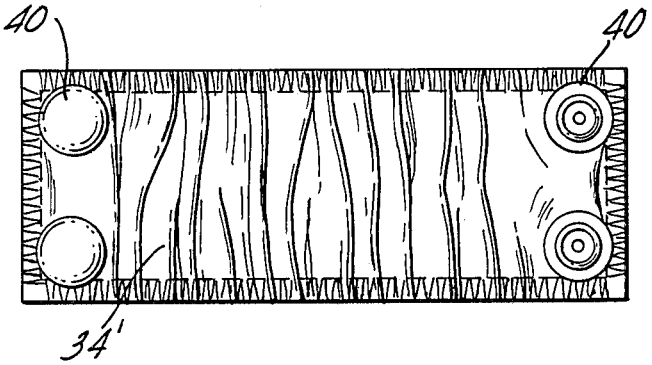
FIG. 4 is a representation of another embodiment of the present invention using a corrugated outer cover and in extended position.
Figure 5:
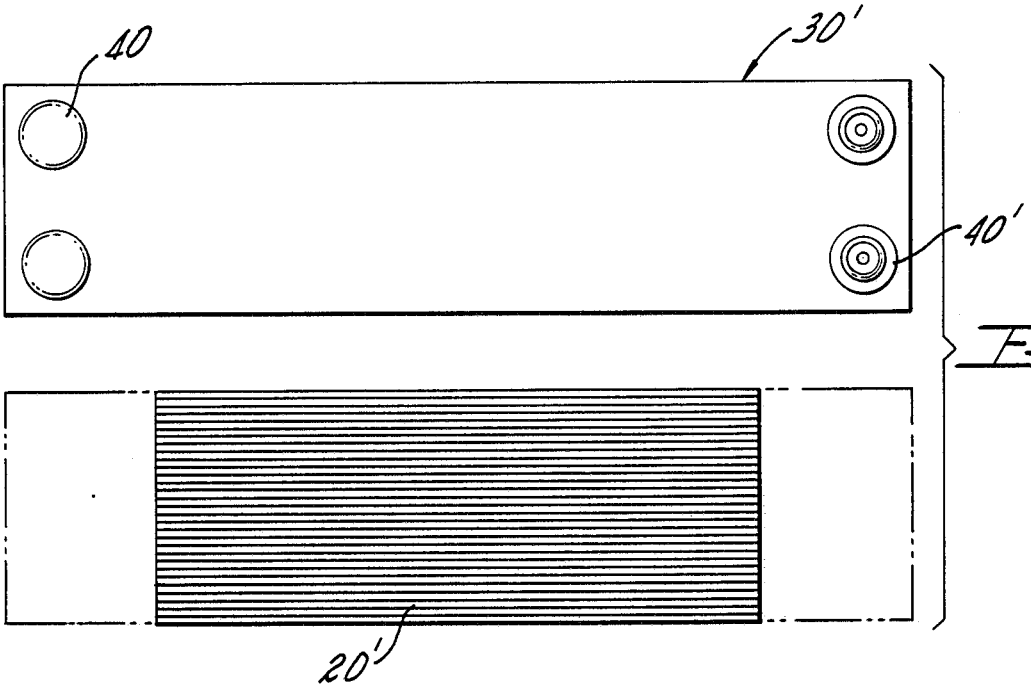
FIG. 5 shows a plan view of the flexible sheet and elastic member used in the embodiment shown in FIG. 4.
Figure 6:
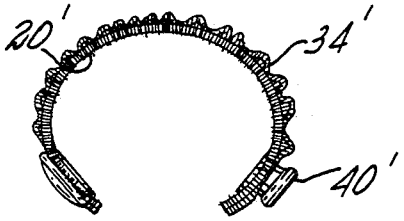
FIG. 6 shows an end view of the hair gripper device shown in FIG. 4, at rest, showing the arc shape it adopts.

In FIGS. 4, 5 and 6, an alternate embodiment is shown where outer layer 34' is a flexible member that may be of any one of a multitude of textures and colors. In FIG. 5, elastic member 20' can be seen at rest and the broken lines indicate how much it is stretched when it is affixed to flexible sheet member 30; making it corrugate.

Figure 7:
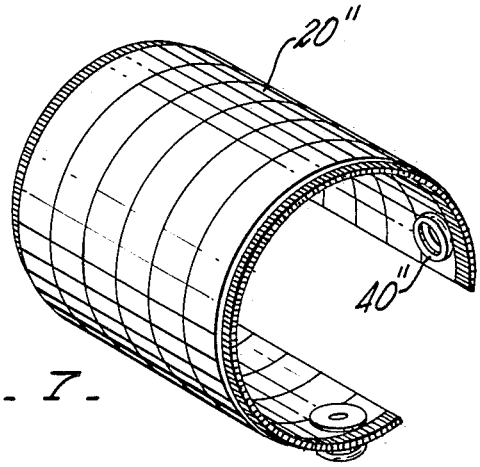
FIG. 7 shows still another embodiment for this invention using an elastic band and no other outer cover.

Still another alternate embodiment for the present invention is represented in FIG. 7 where the elastic member 20'' includes ornamented features on its outer surface thereby assuming the function of sheet member 30 and 30' in the previously described embodiments.

Fastening means 40; 40' and 40' are preferably implemented with snap buttons since they have been found to provide the necessary function of keeping a good grip on the hair along with elastic member 20; 20' and 20''.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A hair gripper device, comprising:

A. an elongated flexible sheet having an inner surface and two ends;

B. an elastic member shorter than said flexible sheet and said elastic member being affixed to said flexible sheet at its ends only thereby providing the necessary gripping pressure to the hair and said elastic member being affixed to said inner surface on stretched state;

C. cooperating fastening means mounted to said ends so that said ends may be secured against each other.

2. The device set forth in claim 1 wherein said flexible sheet includes inner and outer layers of flexible materials that are affixed to each other and said outer layer having ornamental features.

3. The device set forth in claim 2 wherein said fastening means includes snap buttons.

* * * * *